US008091719B2

(12) United States Patent
Wu

(10) Patent No.: US 8,091,719 B2
(45) Date of Patent: Jan. 10, 2012

(54) CONTAINER CAP

(76) Inventor: Hung Kuan Wu, Taipei (TW)

( * ) Notice: Subject to any disclaimer, the term of this patent is extended or adjusted under 35 U.S.C. 154(b) by 673 days.

(21) Appl. No.: 12/292,221

(22) Filed: Nov. 14, 2008

(65) Prior Publication Data

US 2010/0122966 A1 May 20, 2010

(51) Int. Cl.

| | |
|---|---|
| ***B65D 55/02*** | (2006.01) |
| ***B65D 50/02*** | (2006.01) |
| ***B65D 41/06*** | (2006.01) |
| ***B65D 41/36*** | (2006.01) |
| ***B65D 41/04*** | (2006.01) |
| ***B65D 41/34*** | (2006.01) |
| ***B65D 43/18*** | (2006.01) |
| ***B65D 51/18*** | (2006.01) |
| ***B65D 39/00*** | (2006.01) |
| ***A61J 1/00*** | (2006.01) |
| ***A61J 1/03*** | (2006.01) |
| ***B65G 59/00*** | (2006.01) |

(52) U.S. Cl. ..... 215/206; 215/208; 215/332; 215/334; 220/259.3; 220/253; 220/790; 221/151; 221/152

(58) Field of Classification Search ..... 215/206, 215/208, 332, 334, 230; 220/259.3, 253, 220/786, 790; 221/151, 152
See application file for complete search history.

(56) References Cited

U.S. PATENT DOCUMENTS 5,099,999 A * 3/1992 Balien ..... 206/536
5,476,181 A * 12/1995 Seidler ..... 215/223

* cited by examiner

*Primary Examiner* — Anthony Stashick
*Assistant Examiner* — Andrew T Kirsch
(74) *Attorney, Agent, or Firm* — Rosenberg, Klein & Lee

(57) ABSTRACT

An improved container cap has a structural design for preventing pills from spilling out of a container closed with the container cap. The container cap includes a movable cover that is extensible to enable indirect, two-step dispensing of pills, so that the pills come out of the container at a reduced speed and will not fall out accidentally.

5 Claims, 6 Drawing Sheets

CONTAINER CAP

BACKGROUND OF THE INVENTION

1. Technical Field

The present invention relates to container caps, and more particularly, to an improved structure of a container cap for sealing the opening of a container for storing pills or various particulate objects.

2. Description of Related Art

Generally, a container for storing medicine, such as pills, has an opening sealingly closed by a cap and having a relatively large diameter to facilitate the dispensing of pills from the container.

When the cap is turned open, the opening of the container that was sealingly closed by the cap is completely exposed to allow the pills to come out. However, it is difficult to let out the desired number of pills precisely. Chances are a larger number of pills than needed will spill out by accident, so that the person ready to take the medicine must first take the trouble of putting the extra pills back into the container, thus exposing the pills to contamination. It is believed that many people, particularly those unwell, must have the experience that, due to an awkward operation resulting from poor health condition, pills or a container storing the pills drops to the ground unintentionally and, as a result, the pills are scattered all over the places and soiled.

BRIEF SUMMARY OF THE INVENTION

In view of the shortcomings of the aforementioned container cap that, when turned open, directly expose the opening of the container to the fullest, the inventor of the present invention after contemplating ways of improvement and putting years of experience into research and experiments, finally succeeded in producing an improved structural design for a container cap.

The present invention provides a container cap having an improved structural design to prevent pills from spilling out of a container closed with the container cap. The container cap includes a movable cover that is extensible to enable indirect, two-step dispensing of the pills, so that the pills come out of the container at a reduced speed and will not fall out accidentally. The movable cover is also configured to prevent unintentional opening, so that the movable cover can be pulled up to an open state only when it is rotated to a specific position, thereby enabling the two-step dispensing of the pills and keeping the pills from spilling out.

BRIEF DESCRIPTION OF THE SEVERAL VIEWS OF THE DRAWINGS

The structure and objectives as well as a preferred mode of use and the spirit of the present invention will be best understood by referring to the following detailed description of an illustrative embodiment in conjunction with the accompanying drawings, wherein.

DETAILED DESCRIPTION OF THE INVENTION

Figure 1:
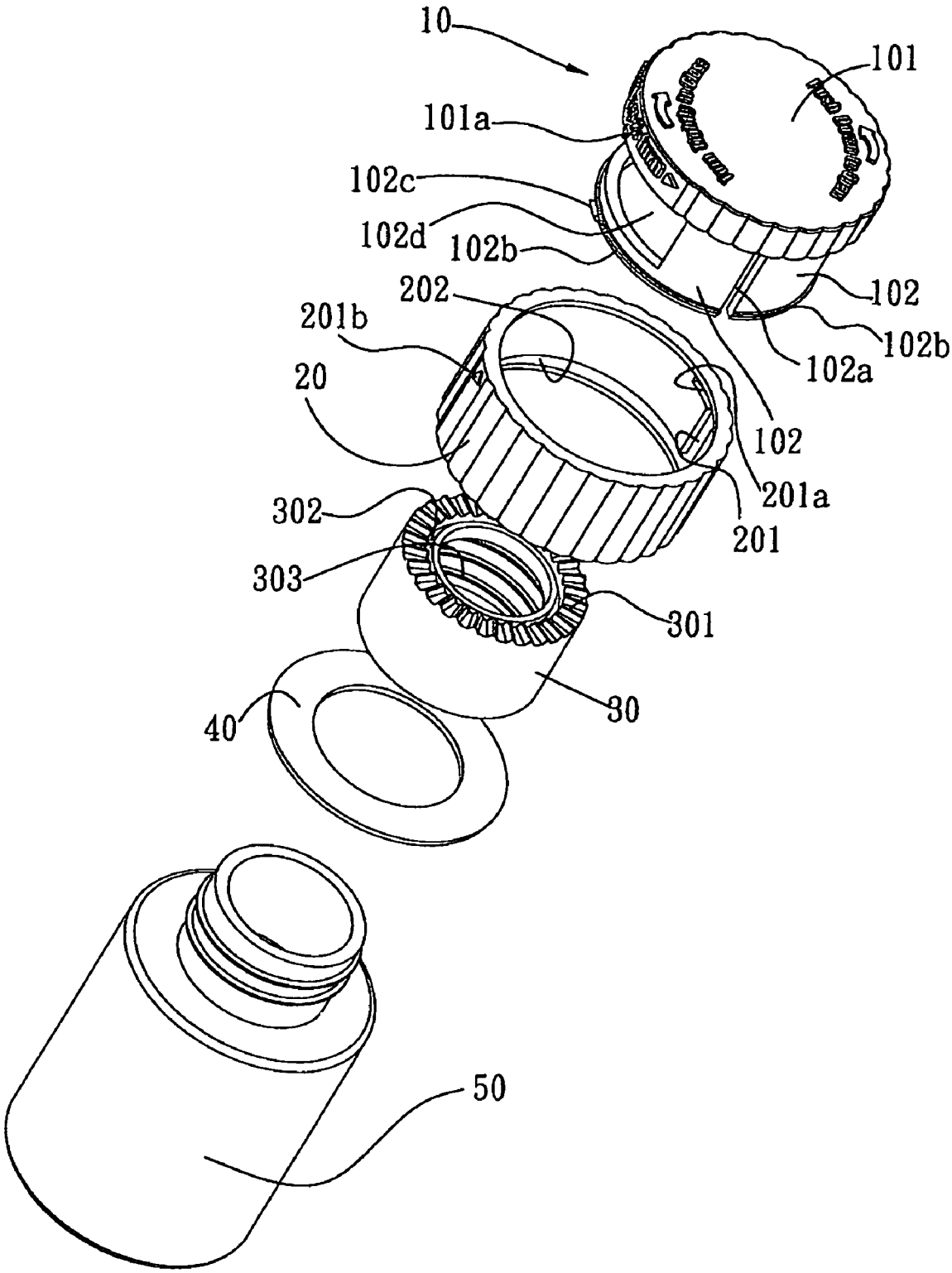
FIG. 1 is an exploded perspective view of a container cap according to the present invention.

Referring to FIG. 1 for an exploded, perspective view of a container cap according to the present invention, the container cap includes a movable cover 10, an outer annular housing 20, an inner cover 30 and an annular plate 40.

Figure 4:
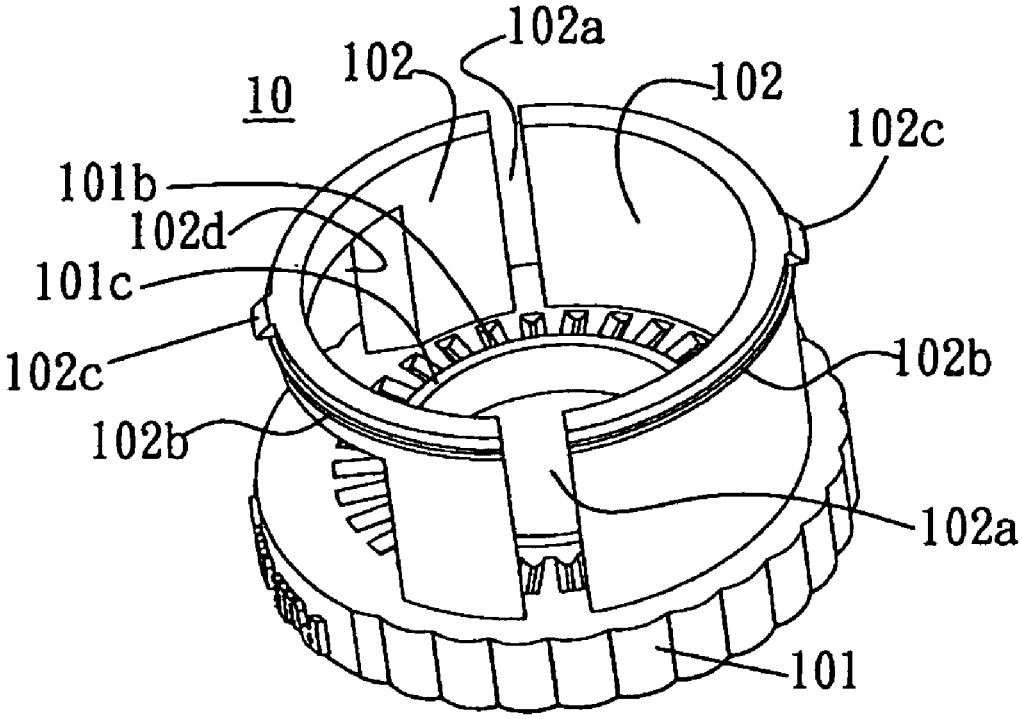
FIG. 4 is a perspective view of a movable cover according to the present invention.
Figure 4A:
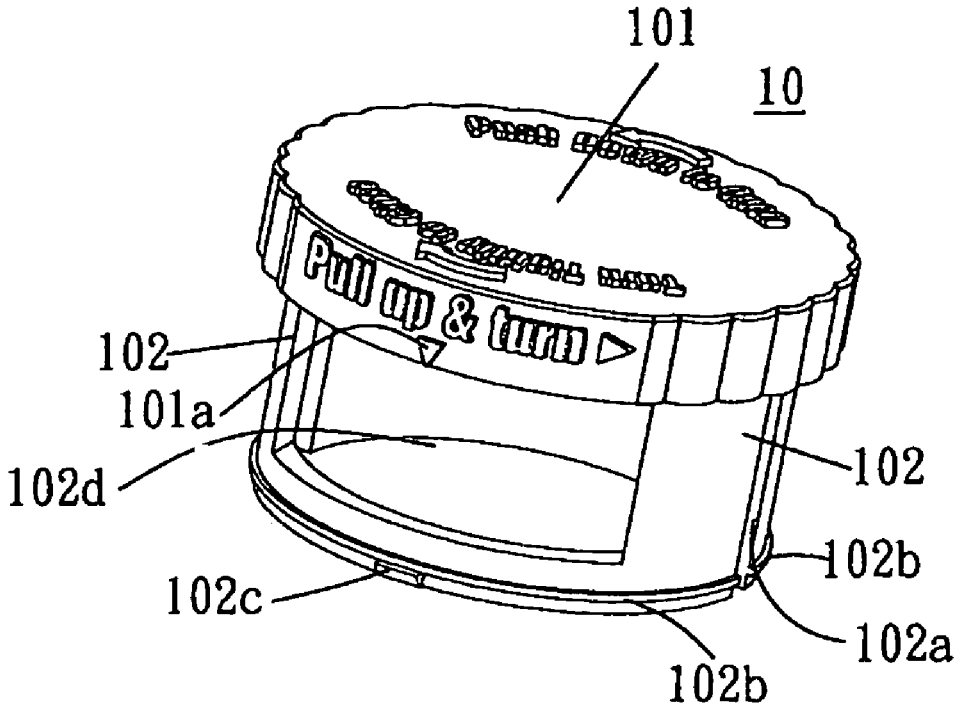
FIG. 4A is another perspective view of the movable cover according to the present invention.

The movable cover 10 (shown in more detail in FIGS. 4 and 4A) has a top panel 101. An insertion tube 102 extending from a bottom of the top panel 101 is formed with slits 102*a* and has a bottom formed with a flange 102*b* and two corresponding protuberances 102*c*. The insertion tube 102 further has a front side formed with an opening 102*d*. A marker block 101*a* is protrudingly formed on an outer periphery of the top panel 101 in vertical alignment with one of the protuberances 102*c* at the bottom of the insertion tube 102. In addition, the bottom of the top panel 101 is centrally provided with an annular, toothed surface 101*b* and an annular projection 101*c*.

Figure 3:
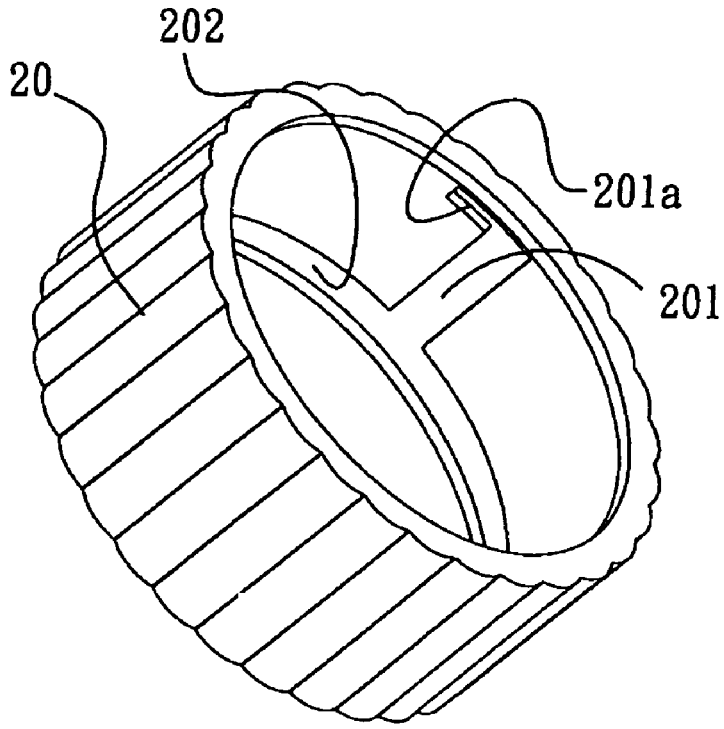
FIG. 3 is a perspective view of an outer annular housing according to the present invention.
Figure 3A:
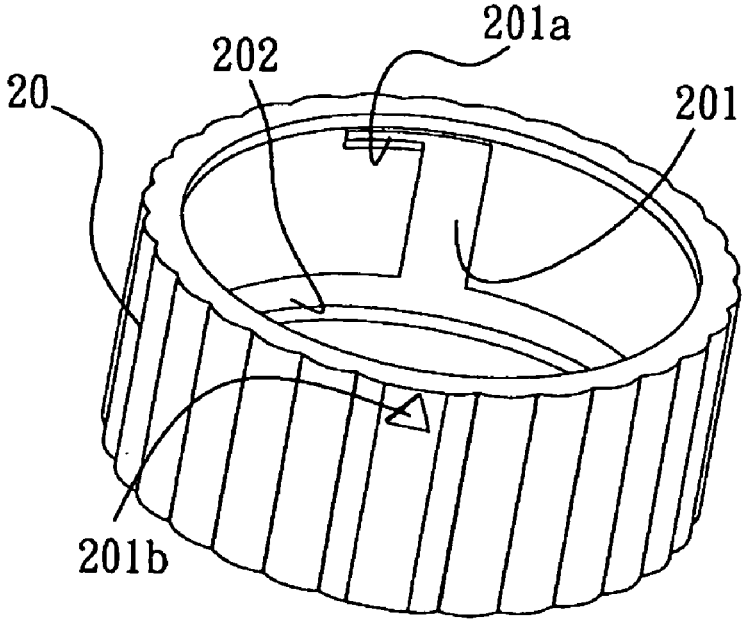
FIG. 3A is another perspective view of the outer annular housing according to the present invention.

The outer annular housing 20 (shown in a more detailed way in FIGS. 3 and 3A) has a through hole and an inner annular surface concavely formed with two corresponding, vertical grooves 201. Each of the two grooves 201 has an end extended transversely with an insertion slot 201*a*. In addition, the inner annular surface of the outer annular housing 20 has a bottom portion formed with an annular recess 202. Furthermore, the outer annular housing 20 has an outer periphery having an upper portion protrudingly formed with a marker block 201*b* corresponding in position to one of the grooves 201.

Figure 5:
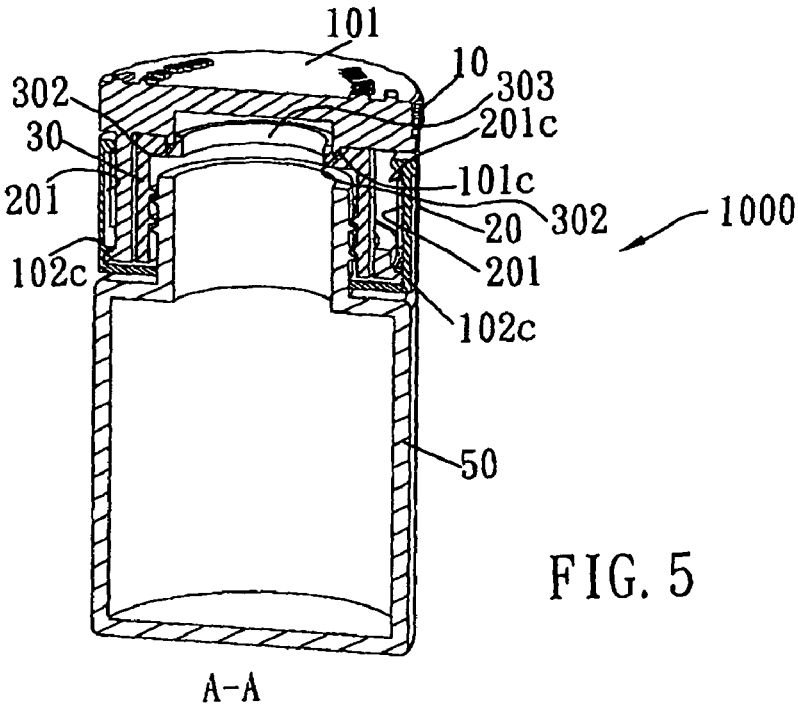
FIG. 5 is a sectional view of the container cap according to the present invention taken along a line A-A in FIG. 2.

The inner cover 30 has a top formed with an annular, toothed surface 301 while an annular notch 302 is provided at an inner periphery of the toothed surface 301. The inner cover 30 also has a through hole 303 formed centrally therein. As shown in FIG. 5, the annular, toothed surface 301 is engageable with the annular, toothed surface 101*b* at the bottom of the top panel 101 of the movable cover 10. In addition, the annular notch 302 can mate with the annular projection 101*c* at the bottom of the top panel 101 of the movable cover 10. The annular plate 40 can be fixedly installed at a bottom of the outer annular housing 20.

Figure 2:
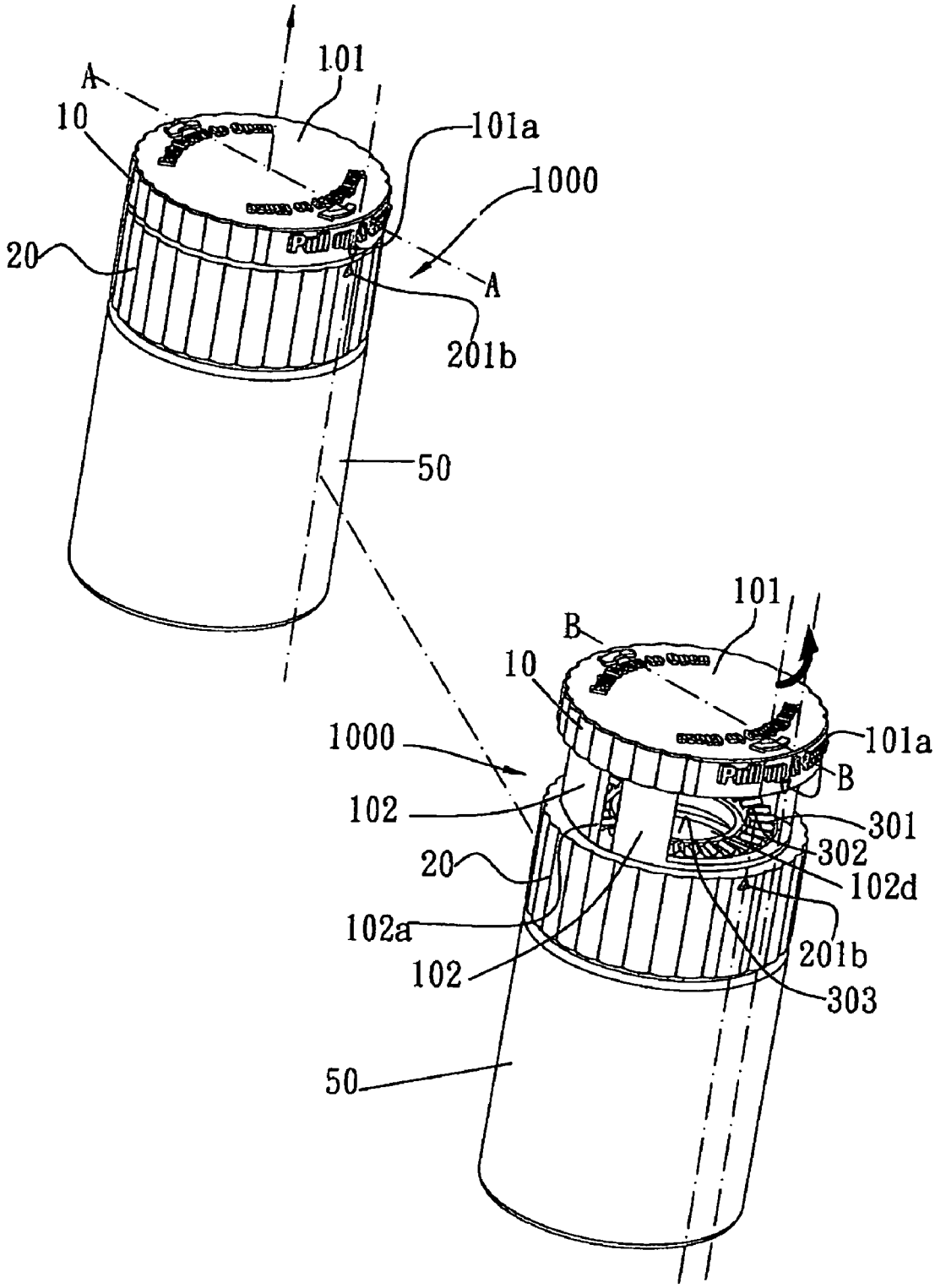
FIG. 2 is a perspective view of the container cap according to the present invention when secured to a container, showing use of the container cap.

To assemble the container cap, the insertion tube 102 of the movable cover 10 is inserted into the through hole of the outer annular housing 20. While doing so, the slits 102*a* formed on the insertion tube 102 provide contraction spaces to facilitate insertion of the insertion tube 102 in place, so that the flange 102*b* and the two protuberances 102*c* at the bottom of the insertion tube 102 are engaged in the annular recess 202 on the bottom portion of the inner annular surface of the outer annular housing 20. In consequence, the movable cover 10 is prevented from disengagement from the outer annular housing 20 and is capable only of axial rotation. Next, the inner cover 30 is put in place so that the annular, toothed surface 301 and the annular notch 302 of the inner cover 30 are engaged with the annular, toothed surface 101*b* and the annular projection 101*c* at the bottom of the top panel 101 of the movable cover 10, respectively. Finally, the annular plate 40 is fixedly installed at the bottom of the outer annular housing 20 to form the container cap 1000, which can be used to sealingly close an opening of a container 50, as shown in FIGS. 2 and 5.

Figure 6:
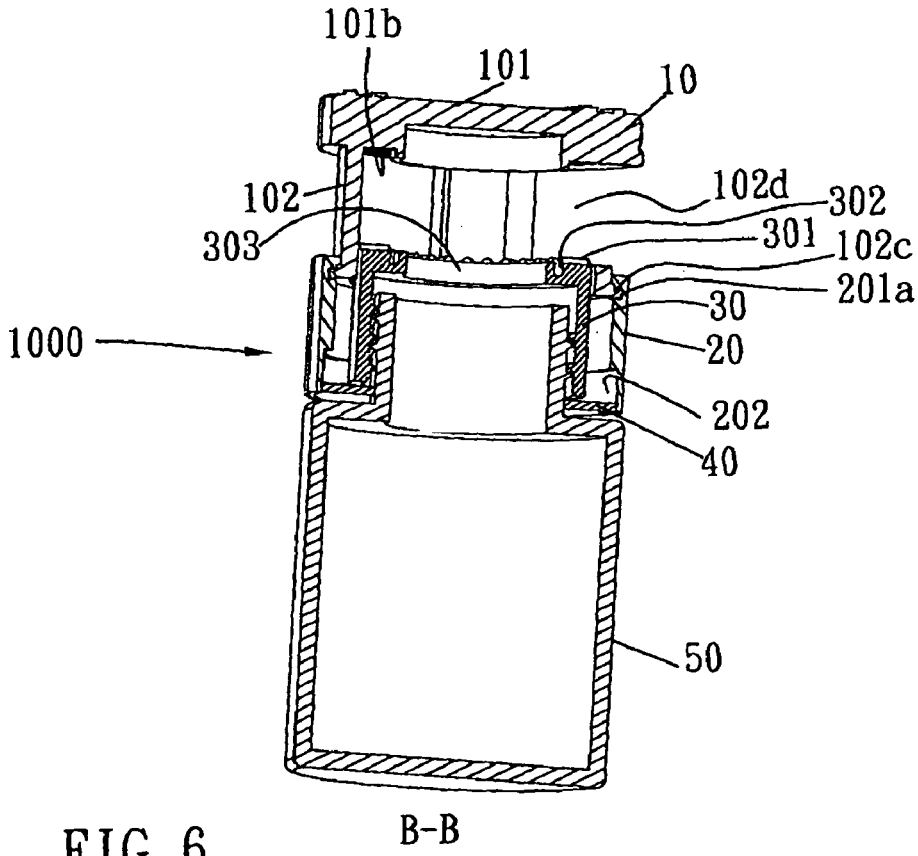
FIG. 6 is a sectional view of the container cap according to the present invention taken along a line B-B in FIG. 2.

The flange 102*b* and the two protuberances 102*c* of the insertion tube 102 of the movable cover 10, when engaged in the annular recess 202 on the bottom portion of the inner annular surface of the outer annular housing 20, cannot be disengaged and is capable only of axial rotation, making it impossible to pull the movable cover 10 up to an open state. In other words, the movable cover 10 is locked. Referring to FIGS. 2, 5 and 6, the movable cover 10 cannot be pulled up to the open state unless the movable cover 10 is rotated so that the two protuberances 102*c* of the insertion tube 102 are aligned with the two grooves 201 on the inner annular surface of the outer annular housing 20. Alignment between the protuberances 102*c* and the two grooves 20 is achieved by rotating the movable cover 10 and aligning the marker block 101*a* thereof with the marker block 201*b* of the outer annular housing 20.

To secure the container cap 1000 onto the container 50, the container cap 1000 is placed directly on top of the container 50, and the movable cover 10 is pressed downward to engage the annular, toothed surface 101*b* thereof with the annular, toothed surface 301 of the inner cover 30. Then, the movable cover 10 is rotated so that the inner cover 30 is driven downward to seal the container 50.

The container 50 serves to store pills or other particulate objects.

In addition, the opening 102*d* on the front side of the insertion tube 102 of the movable cover 10 may be sized according to practical needs.

FIG. 2 is a perspective view of the container cap 1000 secured to the container 50 and demonstrates use of the container cap 1000. As shown in the drawing, when it is desired to take out the pills stored in the container 50 (referring also to FIGS. 5 and 6), the movable cover 10 is rotated to align the marker block 101*a* on the outer periphery of the top panel 101 of the movable cover 10 with the marker block 201*b* of the outer annular housing 20. Consequently, the two protuberances 102*c* at the bottom of the insertion tube 102 of the movable cover 10 correspond in position to the two grooves 201 on the inner annular surface of the outer annular housing 20, respectively. Next, the movable cover 10 is directly pulled up to a predetermined position and rotated slightly, allowing the two protuberances 102*c* at the bottom of the insertion tube 102 to enter and be retained by the insertion slots 201*a* extending transversely from the ends of the two grooves 201, respectively. Thus, the movable cover 10 is prevented from moving downward to enable dispensing of the pills from the opening 102*d* on the front side of the insertion tube 102.

Figure 7:
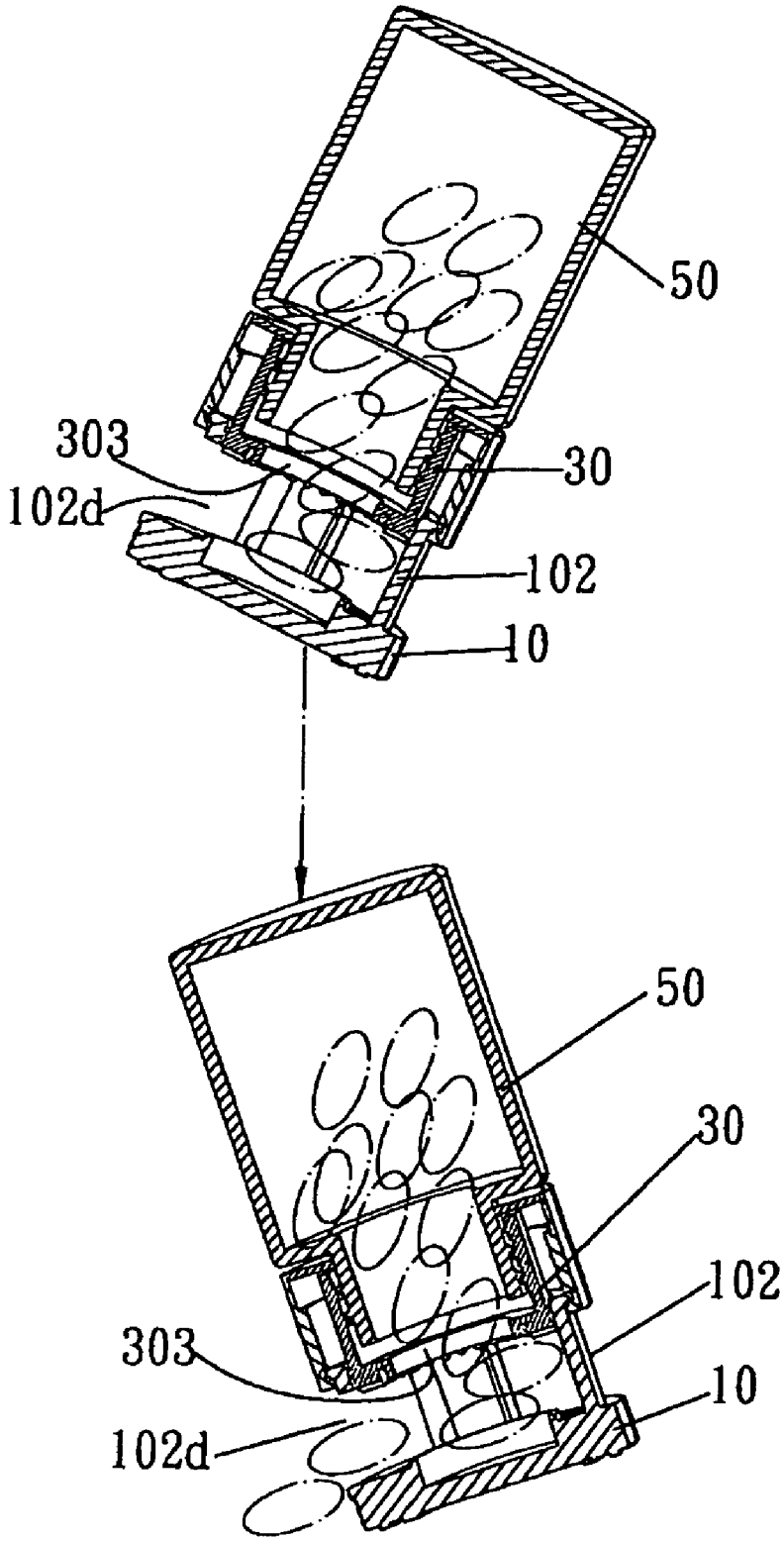
FIG. 7 provides schematic drawings showing dispensing of pills with the container cap according to the present invention.

FIG. 7 schematically shows how the pills are dispensed with the container cap of the present invention. To begin with, as shown in the drawing, the container 50 is tilted to a first angle such that the pills stored therein fall into the insertion tube 102 of the movable cover 10 through the through hole 303 of the inner cover 30 and are temporarily stopped. Then, the container 50 is tilted to a second angle to allow a desired number of pills to come out of the opening 102*d* of the movable cover 10. This indirect, two-step dispensing process not only prevents the pills from spilling out, but also helps control the number of pills dispensed.

In conclusion, the present invention has been demonstrated to serve the intended purposes. In addition, the present invention has not been put to public use and satisfies the requirements of utility and novelty for patent application. Therefore, an application for patent of the present invention is hereby lawfully filed for examination.

The invention claimed is:

1. A container cap, comprising:

a movable cover, comprising a top panel having a bottom extended with an insertion tube, wherein the insertion tube is formed with slits and has a bottom formed with a flange and two corresponding protuberances, and the insertion tube further has a front side formed with an opening, in which the top panel has an outer periphery protrudingly formed with a marker projection in vertical alignment with one said protuberance at the bottom of the insertion tube, and the top panel further has a bottom centrally formed with an annular, toothed surface and an annular projection;

an outer annular housing, having a through hole and an inner annular surface concavely formed with two corresponding, vertical grooves, each said groove having an end transversely extended with an insertion slot, wherein the outer annular housing has an inner annular surface comprising a bottom portion formed with an annular recess, and the outer annular housing further has an outer periphery comprising an upper portion protrudingly formed with a marker projection corresponding in position to one said groove;

an inner cover, having a top formed with an annular, toothed surface having an inner periphery provided with an annular notch, the inner cover further having a through hole; and an annular plate, to be fixedly installed at a bottom of the outer annular housing;

wherein the container cap is assembled by: inserting the insertion tube of the movable cover into the through hole of the outer annular housing, with the slits formed on the insertion tube providing contraction spaces to facilitate the insertion of the insertion tube in place, so that the flange and the two protuberances at the bottom of insertion tube are engaged in the annular recess on the bottom portion of the inner annular surface of the outer annular housing, thereby preventing the movable cover from disengagement and allowing only axial rotation of the movable cove; placing the inner cover so that the annular, toothed surface and the annular notch of the inner cover are engaged with the annular, toothed surface and the annular projection at the bottom of the top panel of the movable cover, respectively; and installing the annular plate fixedly at the bottom of the outer annular housing to complete the container cap, which serves to sealingly close an opening of a container.

2. The container cap of claim 1, wherein the toothed surface of the inner cover is engageable with the toothed surface at the bottom of the top panel of the movable cover.

3. The container cap of claim 1, wherein the annular notch of the inner cover mates with the annular projection at the bottom of the top panel of the movable cover.

4. The container cap of claim 1, wherein the movable cover is allowed to be pulled up, after the movable cover is rotated to align the marker projection thereof with the marker projection of the outer annular housing and thus align the two protuberances of the movable cover with the vertical grooves on the inner annular surface of the outer annular housing.

5. The container cap of claim 1, wherein the opening on the front side of the insertion tube of the movable cover is sized as needed.

* * * * *